US005655959A

United States Patent [19]

Juranitch

[11] Patent Number: 5,655,959

[45] Date of Patent: Aug. 12, 1997

[54] KNIFE EDGE SHARPENER

[76] Inventor: John Juranitch, P.O. Box 150, Ely, Minn. 55731

[21] Appl. No.: 439,304

[22] Filed: May 11, 1995

Related U.S. Application Data

[63] Continuation of Ser. No. 110,615, Aug. 20, 1993, abandoned.

[51] Int. Cl.[6] ..... B24B 3/54

[52] U.S. Cl. ..... 451/486; 76/82; 76/86; 76/88; 451/553; 451/555

[58] Field of Search ..... 451/486, 553, 451/555; 76/82, 86, 88

[56] References Cited

U.S. PATENT DOCUMENTS

| | | | |
|---|---|---|---|
| 578,440 | 3/1897 | Beaudin . | |
| 1,041,631 | 10/1912 | Johnson . | |
| 1,570,083 | 1/1926 | Runzi . | |
| 1,851,520 | 3/1932 | Moller . | |
| 1,894,579 | 1/1933 | Blankner | 51/354 |
| 1,909,743 | 5/1933 | Blankner . | |
| 2,460,552 | 2/1949 | Tarapczynski | 51/354 |
| 2,499,786 | 3/1950 | Shain | 51/354 |
| 4,550,632 | 11/1985 | Inman . | |
| 4,934,110 | 6/1990 | Juranitch . | |

FOREIGN PATENT DOCUMENTS

| | | |
|---|---|---|
| 190414 | 10/1906 | Germany . |
| 293785 | 3/1928 | United Kingdom . |
| 517242 | 1/1940 | United Kingdom . |

*Primary Examiner*—Joseph M. Gorski
*Attorney, Agent, or Firm*—Schroeder & Siegfried, P.A.

[57] ABSTRACT

Apparatus for providing a sharpened edge on an elongated cutting tool comprising a base member having an elongated slot therein and a pair of elongated sharpening elements each pivotally mounted on the base member at opposite sides of the upper end portion of the slot and extending in crossed relation and intersecting at the slot as a cutting tool is drawn downwardly and outwardly through the slot. Separate counterweights are connected to the upper end portions of each of the sharpening elements to resist their downward pivoting movement as the cutting tool is so drawn through the slot. Separate eccentrically mounted cams are disposed between each cutting tool and its axis of pivot to adjustably control the extent of swinging movement of each of the sharpening elements in both directions. Each sharpening element extends downwardly from its axis of pivot and is curved upwardly, and has terminal portions which are relatively straight and extend slightly therebeyond and downwardly relative to its more curved portion. A third sharpening element is pivotally mounted outwardly of the pair and on the same axis of pivot as the innermost sharpening element, extends in the same general direction, and has a counterweight which is similar but of lesser mass.

23 Claims, 5 Drawing Sheets

11
A
10
19
24
25
14
15
26
18
28
22
21
29
27

KNIFE EDGE SHARPENER

This application is a continuation of application Ser. No. 08/110,615, filed Aug. 20, 1993 and now abandoned.

BACKGROUND OF THE INVENTION AND PRIOR ART

The closest prior art of which I have knowledge is my U.S. Pat. No. 4,934,110, which shows an edge sharpening apparatus designed for similar purposes. Some of the patents cited against said patent are also pertinent. I have improved such apparatus, however, in a number of ways so as to provide an improved cutting tool sharpener. The historical background and the need for the finest cutting tool sharpeners is clearly set forth in said patent in columns 1 and 2, and is incorporated herein by reference thereto. In addition, it should be noted that fatigue caused by the use of a knife which is not adequately sharpened makes the fatigued user more accident prone. My present invention includes all of the advantages of said patent and provides substantially increased benefits as described hereinafter.

BRIEF SUMMARY OF THE INVENTION

My new invention has a number of improved features over those disclosed in my U.S. Pat. No. 4,934,110. I have provided a pair of eccentrically mounted cams which are adjustable to adjust the extent of downward movement of the counterweights and thereby adjust the angle of the V-shape defined by the two crossed sharpening elements which intersect at the slot, which in turn adjusts the bevel defined by those elements. At the same time, the extent of the downward swinging movement of each of the sharpening elements is adjusted, in that each sharpening element engages the side of the eccentrically mounted cam opposite to the side thereof which is engaged by the associated counterweight. This enables the user to adjust the sharpening elements so that the V-shape defined by the sharpening elements will most closely approximate the bevel of the cutting tool being utilized by the user of the sharpening apparatus. As a direct consequence, a more efficient sharpening action will be effected.

A second new feature which I have developed is the provision of terminal portions for each of the sharpening elements which are relatively straight as compared to the upwardly curved sharpening portions.

Thus, the terminal portions of each of said elements, instead of following the curve of the more intermediate portion of each element, tend to straighten out so as to diminish or remove the curvature entirely. This enables the individual, who uses the apparatus to sharpen his knife, to sharpen the tool at a lesser angle or bevel toward the final touches of the sharpening procedure which occur more toward the lower end of the slot. Thus, a better edge can be obtained as the sharpening operation is completed.

I have also provided an improvement in the form of a third sharpening element which is pivotally mounted on the axis of pivot of the sharpening element mounted closest to the base member. This third element has the same degree of curvature as the innermost sharpening element and hence intersects with the second or intermediate sharpening element at the same angle as that defined by the innermost pair. This third sharpening element has a considerably lighter counterweight than those connected to each of the innermost pair and thus, a more truly correct cutting edge is provided, since it extends in a direction opposite to that of its sharpening element most adjacent thereto and, therefore, counteracts the effect thereof to more accurately align the cutting edge, which will otherwise be slightly off true alignment with the central plane of the cutting tool.

BRIEF DESCRIPTION OF THE DRAWINGS

These and other objects and advantages of the invention will more fully appear from the following description, made in connection with the accompanying drawings, wherein like reference characters refer to the same or similar parts throughout the several views, and in which.

DETAILED DESCRIPTION OF THE INVENTION

Figure 1:
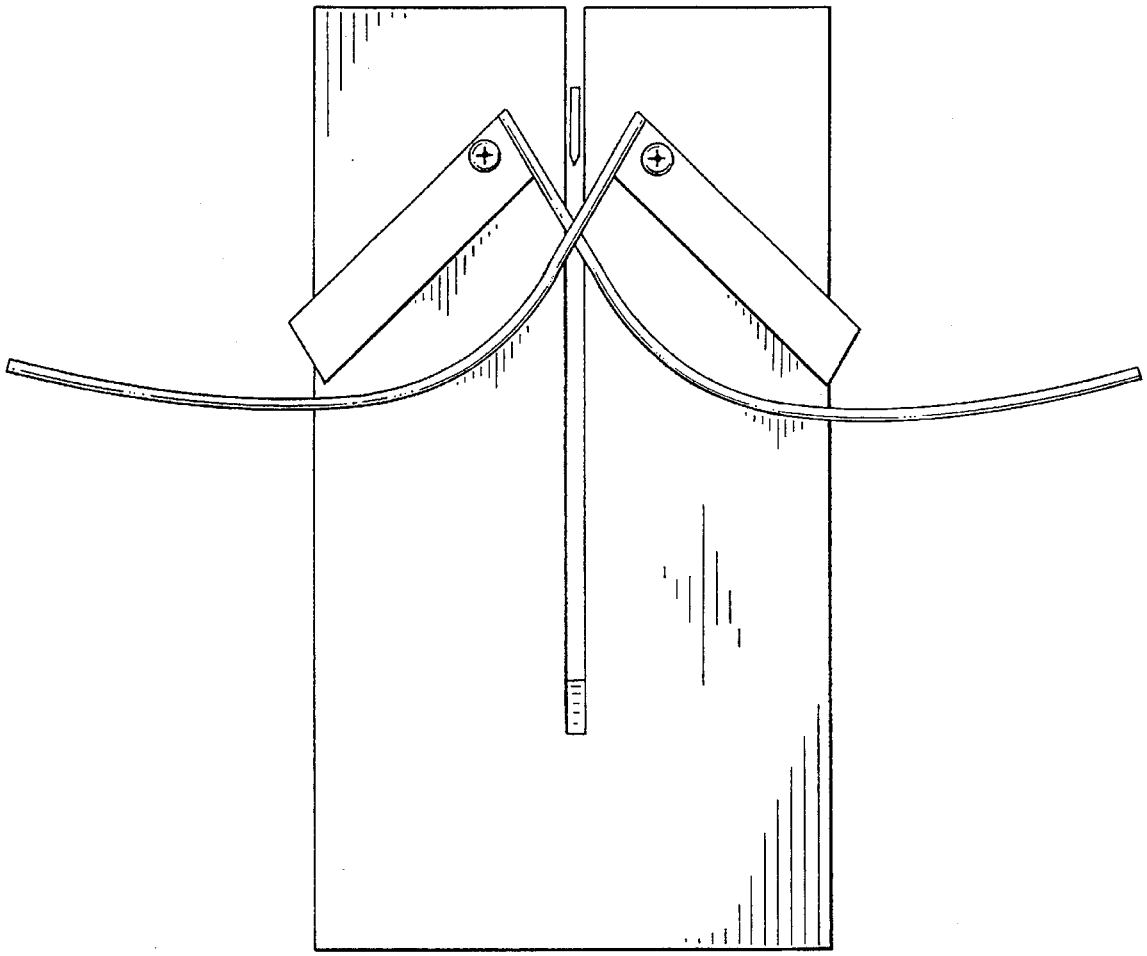
Fig.-1 (PRIOR ART)
FIG. 1 is a front elevational view of an edge sharpening tool of the prior art.
Figure 2:
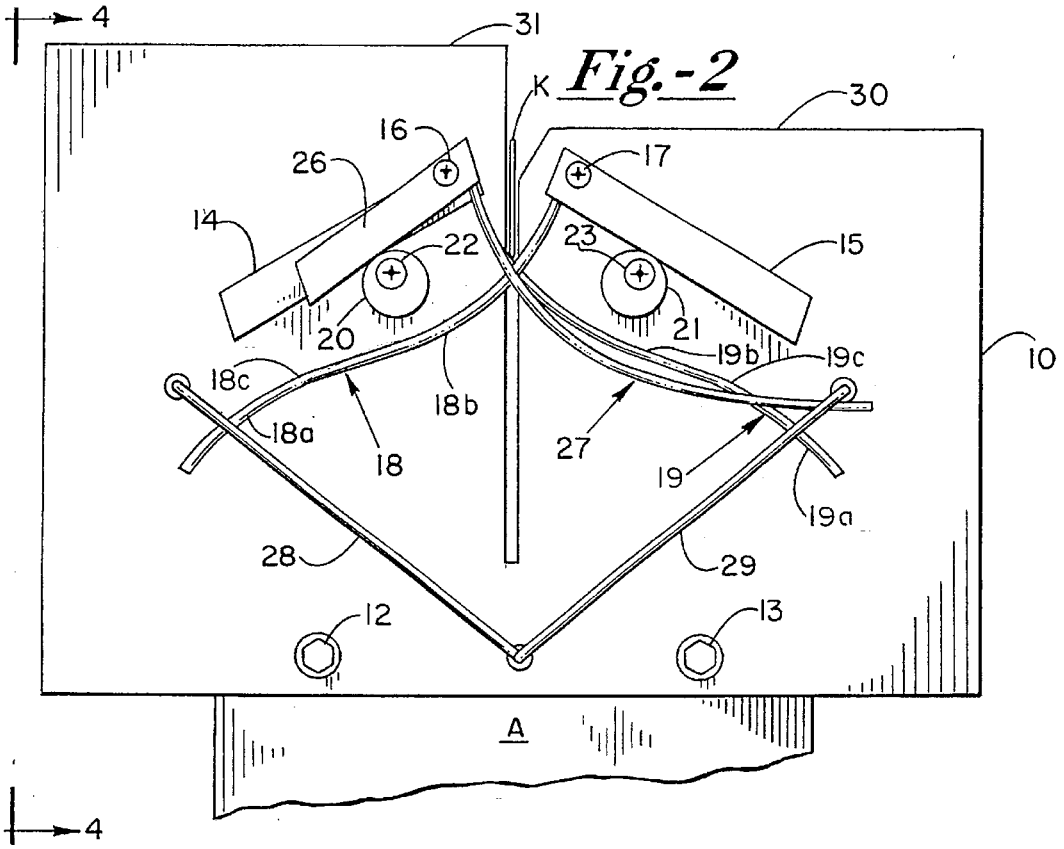
FIG. 2 is a front elevational view of my Edge Sharpening Tool.
Figure 3:
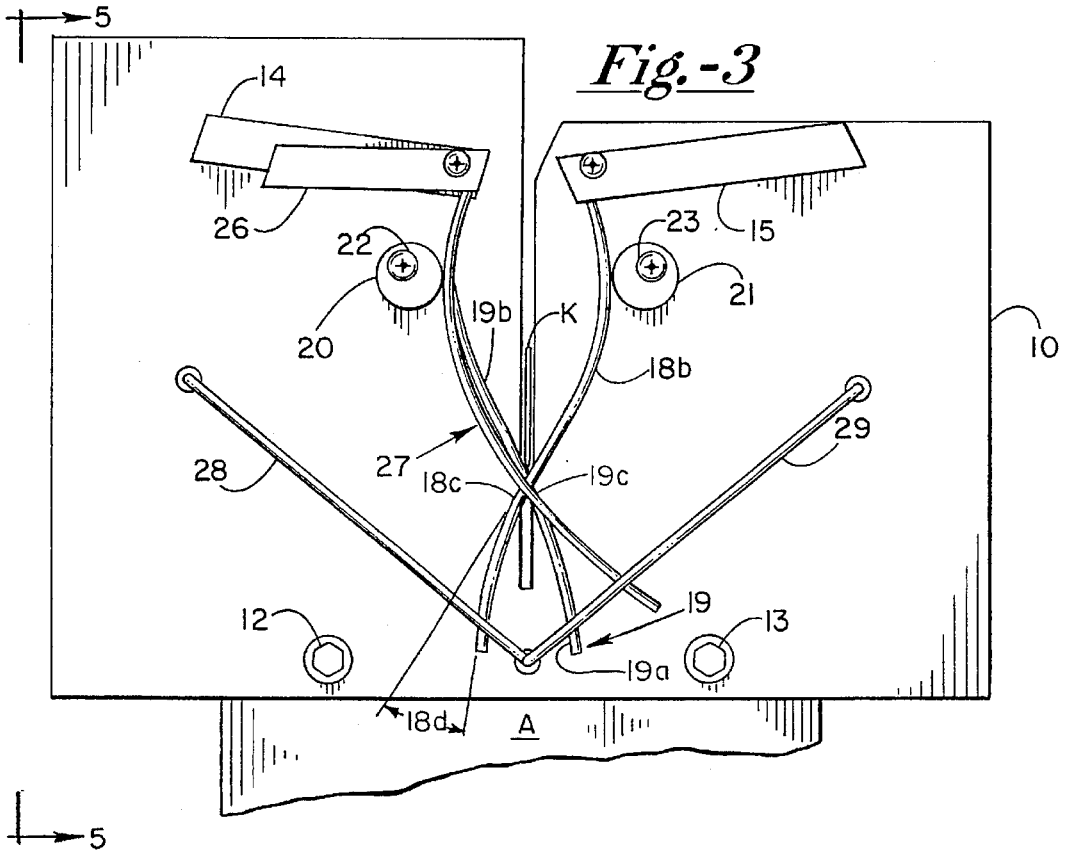
FIG. 3 is a front elevational view thereof, with its sharpening rods at the lower end of their swinging movement.
Figure 4:
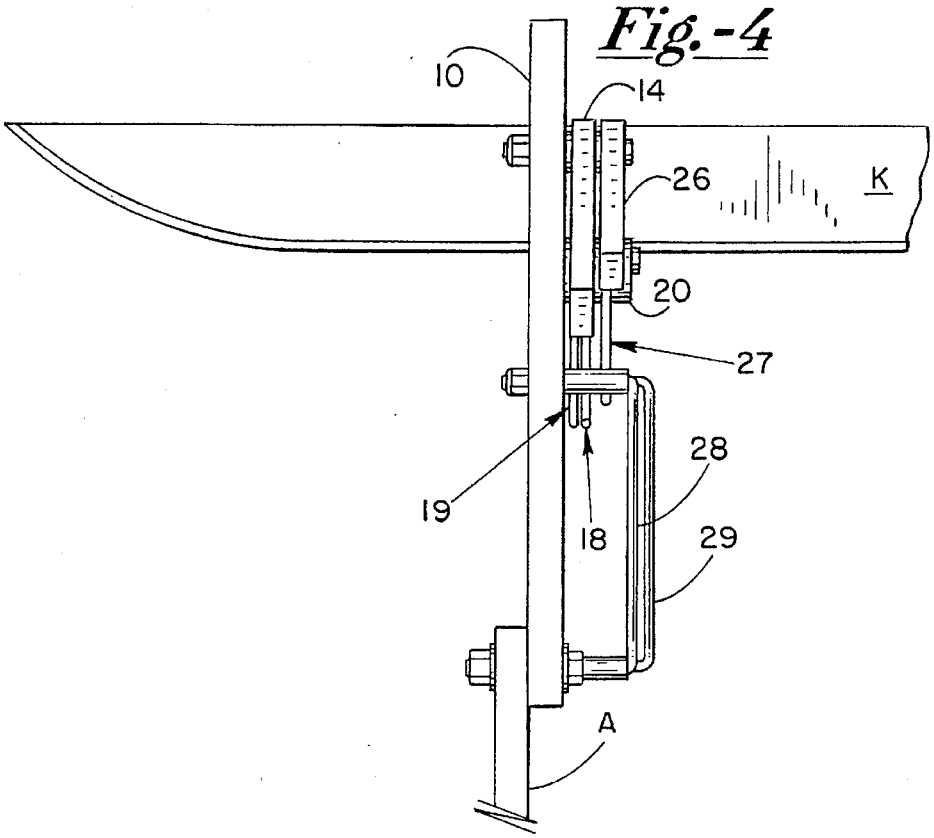
FIG. 4 is a side elevational view thereof, taken along line 4—4 of FIG. 2.
Figure 5:
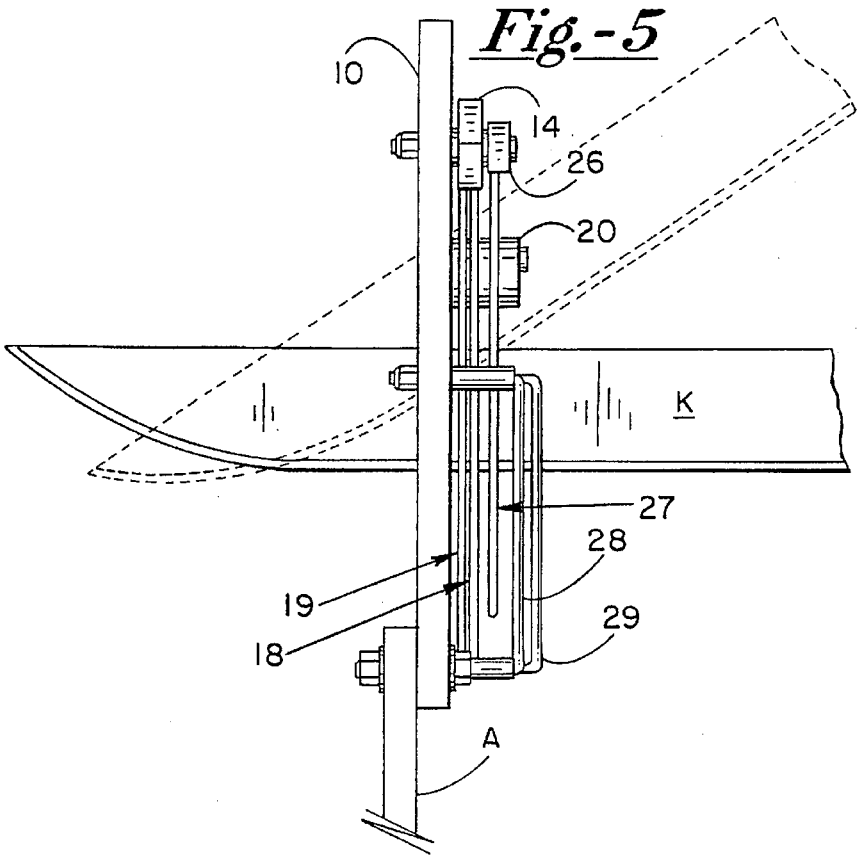
FIG. 5 is a side elevational view thereof, taken along line 5—5 of FIG. 3.

The closest prior art known to me is shown in FIG. 1. One embodiment of my invention, as shown in FIG. 2, includes a base member 10 having an elongated slot 11 extending downwardly from the upper portions of the base and at a right angle to the plane thereof. Preferably the base member is mounted in an erect position by mounting bolts 12 and 13 upon an anchor A.

Pivotally mounted upon the base member 10 equidistant from and at the same elevation is a pair of force means in the form of counterweights 14 and 15 having equal masses and consequently providing equal force values. Each pivots about an axis such as indicated by numerals 16 and 17. A pair of upwardly curved sharpening elements (steels) 18 and 19 are fixedly mounted upon the upper and inner ends of these two counterweights and extend toward each other in crossed relation, intersecting at and along the slot 11 as they are caused to swing downwardly by a knife K being drawn downwardly and through the slot, with its sharp edge engaging the cross sharpening elements 18 and 19.

Eccentrically mounted on the base member 10, at opposite sides of the slot 11, is a pair of cams 20 and 21. These cams are secured to the base member 10 by a pair of bolts 22 and 23 which are provided with Phillips heads to facilitate adjustment of the degree of eccentricity through the use of a conventional Phillips screw-driver. A pair of lock washers 24 and 25 (see FIG. 7) are positioned between the base member 10 and the inner end of the cams 20 and 21 to insure that they will not loosen and rotate, since such rotation of one without corresponding rotation of the other would preclude proper intersection of the sharpening elements 18 and 19 opposite the slot 11.

Figure 7:
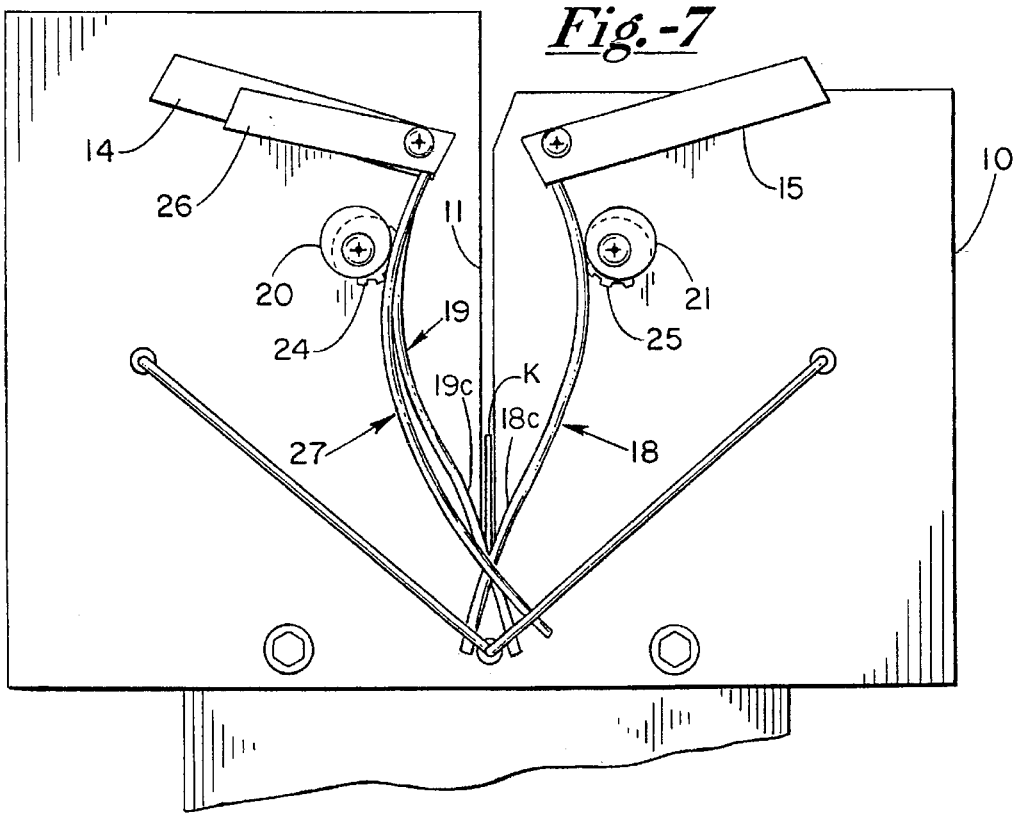
FIG. 7 is a front elevational view thereof, showing the sharpening elements swung to their lowest crossed position.
Figure 8:
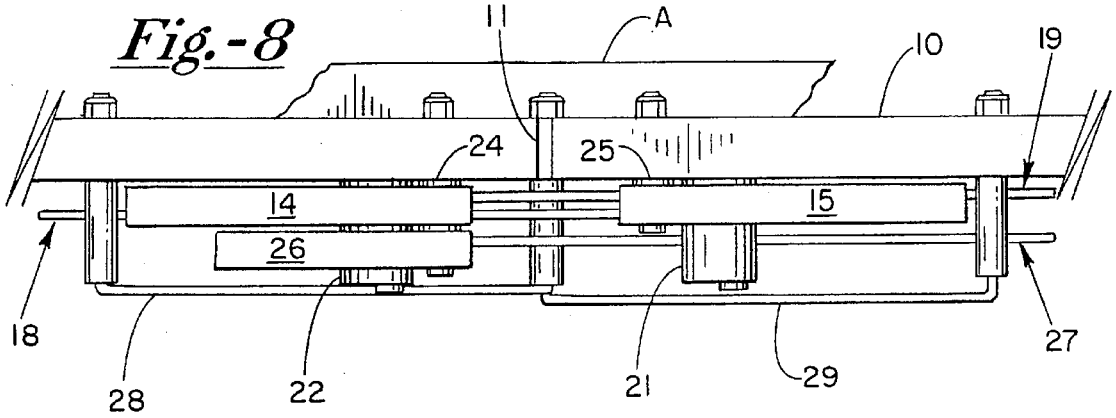
FIG. 8 is a top plan view of the edge sharpening tool shown in FIG. 2.

It will be seen, by reference to FIG. 2, that the terminal portions 18*a* and 19*a* of the sharpening elements 18 and 19, respectively, are relatively straight as compared to the concave portions 18*b* and 19*b* and extend away from the upward curvature of the concavely shaped, portions 18*b* and 19*b*, respectively. Thus, when the cutting edge of the knife to be sharpened reaches these intersecting relatively straight portions 18*a* and 19*a*, the V-shape defined therebetween is less than that defined by the concave upper portions 18*b* and 19*b* and a finer cutting edge can be produced thereby. Thus, the further down the sharpening elements cross, the more the pressure which is required on the knife, and the less the beveling angle will be. It will be noted that the terminal portions 18*a* and 19*a* are convexly curved downwardly slightly beyond a straight orientation and are connected to the upper portions 18*b* and 19*b* by a slightly more convex intermediate portion 18*c* and 19*c*, respectively. As a consequence, the concavity of the upper portions 18*b* and 19*b* terminates at the intermediate portions 18*c* and 19*c*, and the terminal portions 18*a* and 19*a* extend at an angle to the tangent 18*d* of 18*b* and 19*b* at their point of termination of concavity. This point of termination of concavity is at the point where intermediate portions 18*c* and 19*c* join 18*b* and 19*b*, respectively. A line of tangent 18*d* for upper portion 18*b* is shown in FIG. 7, as amended. The upper portions 18*b* and 19*b* are fixedly secured to the counterweights 15 and 14, respectively.

Pivotally co-mounted with the sharpening element 18 about the pivot point 16, is a third counterweight 26 which has a substantially lesser mass than that of each of the two counterweights 14 and 15. Mounted on the inner and upper end of the counterweight 26 is a third sharpening element 27 which extends away from the pivot point 16 and crosses the slot 11, intersecting the sharpening element 19 at and along the slot 11. This sharpening element 27 has the same curvature as the intermediate portions 18*b* of the sharpening element 18.

It will be seen that the upper edge 30 of the base 10 is at a lower elevation at the right of the slot 11, as compared to the upper edge 31 to the left thereof, as viewed in FIG. 2. This facilitates finding the slot to enable the wielder of the knife to sharpen the same without looking at the sharpener, by merely engaging the upper right hand edge 30 and then moving the knife to the left until it engages the upstanding portion to the immediate left of the slot.

Mounted upon the base member 10 in fixed relation thereto and just outwardly of the third sharpening element 27, so as to clear the same, is a pair of guard rods, 28 and 29 which protect the sharpening elements from outside damaging influence.

In use, the knife K is drawn downwardly and through the slot toward the wielder of the knife. As it engages the sharpening elements 18 and 19 where they cross at the slot, its sharpened edge is sharpened. The downward pressure exerted upon these rods 18 and 19 by the knife K, causes the rods to pivot equally and to cooperatively define a bevel which is quite constant during their pivoting or swinging movements. By so drawing the knife K through the slot 10 several times, and by the knife forcing the sharpening elements 18 and 19 to swing away from each other, the keen edge of the knife K can be restored. It is desirable that the angle between the blade and the sharpening element remain essentially constant because it thereby permits a longer stroke of the knife K in the sharpening procedure.

When the knife to be sharpened has had its cutting edge dulled substantially, the knife is drawn repeatedly downwardly through the slot and between the sharpening elements 18 and 19 to the upper end of the relatively straight portions 18*a* and 19*a*. This restores the cutting edge to a condition approaching that prior to its dulling. Thereafter, the final correctly true cutting edge can be obtained by forcing the knife downwardly between the relatively straight end portions 18*b* and 19*b* and drawing same through the lower portions of the slot. The end portions 18*b* and 19*b*, since they have less curvature, sharpen the partially sharpened cutting edge further, since the bevel at which the sharpening elements engage the knife is reduced by the application of the relatively straight portions 18*b* and 19*b*.

Figure 6:
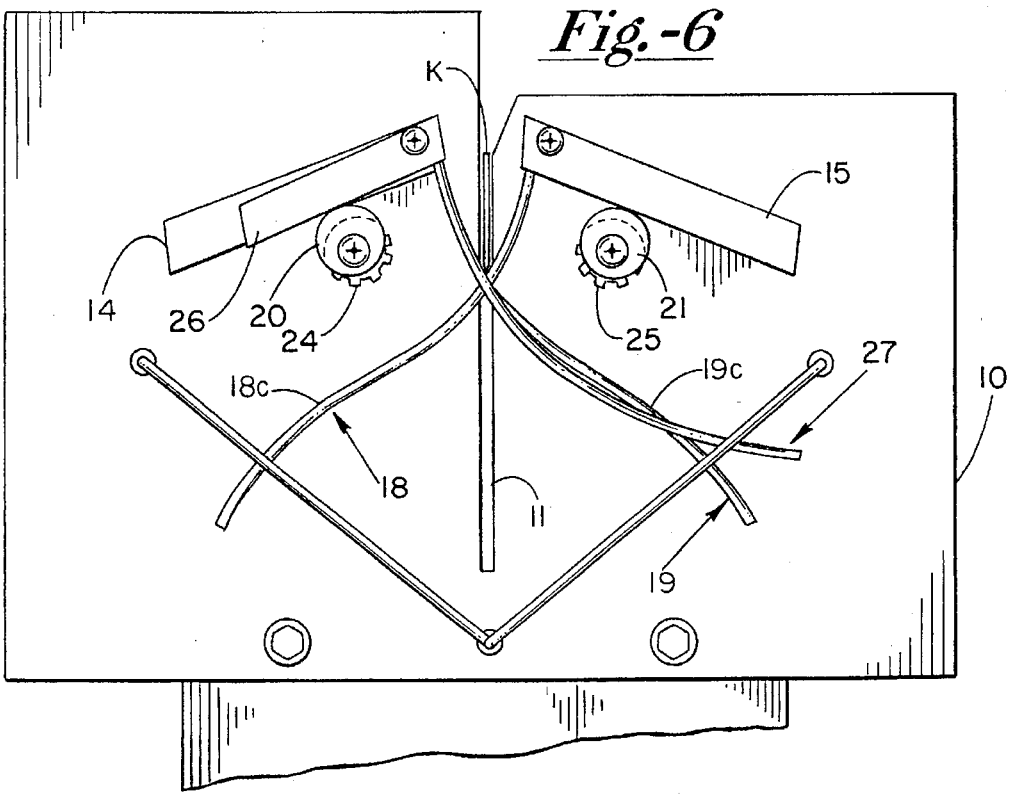
FIG. 6 is a front elevational view thereof, with the pivotally mounted cams adjusted to cause the sharpening elements to cross initially at a lower level and thus provide a lesser bevel and more pressure to the item to be sharpened.

When the cams 20 and 21 are adjusted to positions as shown in FIG. 2, the point along the slot at which the sharpening elements 20 and 21 cross opposite the slot is at its highest elevation and, as a consequence, greater pressure must be exerted upon the knife K in order to cause the sharpening elements to pivot. It is desirable to utilize such increased pressure when the cutting tool to be sharpened has been dulled substantially. This shortens the amount of time required to return such a knife to a reasonably effective condition, which is adequate for certain usages. However, when a more delicate but keener edge is desired on the cutting tool to be sharpened, it is advantageous to adjust the eccentricity of the cams 20 and 21 to a position such as shown in FIG. 6, at which the sharpening elements in their return positions, cross at a lower elevation and consequently lighter pressure is needed to draw the cutting tool K downwardly through the slot 11. As a consequence, a keener edge can be accomplished.

The utilization of a third sharpening element 27 has proved beneficial, in that it modifies and corrects to a substantial degree, the adverse consequence of the fact that the outermore sharpening element 19 (as compared to its cooperating element 18) engages the sharpening edge of the knife K last, as the latter is drawn through the slot 11 toward the wielder of the knife. This circumstance caused the cutting edge not to be true. In other words, the cutting edge is caused to extend slightly laterally of the plane extending parallel to the knife and through its dead center. The action of the third sharpening element 27, being lighter and hence providing reduced pressure, returns the cutting edge toward or to that plane at dead center, and hence the edge becomes truly correct and cuts more effectively and with less pressure. It also removes the fine feather edge, if one exists. Element 27 has slightly less curvature then the sharpening element 18 in order to make its effect less pronounced.

It will be readily appreciated that the degree of eccentricity of the cams 20 and 21 can be readily adjusted by loosening bolts 22 and 23 and then rotating the cams thereabout to the desired positions. Proper adjustment of the cylindrical cams 20 and 21 insures that the sharpening elements intersect at the slot 11. Also, the cams 20 and 21 are of equal diameter and their bores, through which the bolts 22 and 23 extend, are located equidistantly from their respective centers.

It will also be apparent, by reference to FIG. 7, that it is possible to vary the resistance provided by the sharpening elements by adjusting the cams 20 and 21 appropriately. Thus, when adjusted so that the sharpening elements abut the cams 20 and 21 as the knife K reaches the intermediate portions 18*c* and 19*c*, the sharpening elements provide substantially greater resistance to movement of the knife K therebetween since the cams 20 and 21 functions as a fulcrum and the sharpening elements must flex in order for the knife to cause them to spread sufficiently to permit its passage therebetween. As a consequence, substantially greater pressure must be applied to the knife and the sharpening action is increased.

It will, of course, be understood that various changes may be made in the form, details, arrangement and proportions of the parts without departing from the scope of the invention which comprises the matter shown and described herein and set forth in the appended claims.

I claim:

1. Apparatus for providing a sharpened edge on an elongated cutting tool, comprising:

(a) a base member extending in an upright plane and having an elongated vertically extending slot therein;

(b) a pair of elongated sharpening elements, each of which is pivotally secured to said base member at a pivot point adjacent to and on opposite sides of the upper end portion of said slot and each of which is swingable downwardly in crossed relation about its said pivot point along said slot in a plane adjacent and parallel to the plane of said base member;

(c) each of said elements having an upper and a lower end portion and having a curved intermediate portion extending downwardly from said upper end portion and relative to its said pivot point;

(d) force means connected to the upper end portions of each of said sharpening elements in position to apply a predetermined force thereto and having a force value sufficient to urge each of said sharpening elements to maintain its crossed relationship with the other by pivoting toward the other to thereby provide contact sharpening surfaces to each side of the cutting edge of such an elongated cutting tool as the latter is drawn downwardly and outwardly through and away from said slot;

(e) separate adjustable abutment means carried by said base member at opposite sides of said slot in position to limit and vary the amount of the downward swinging crossing movement of each of said sharpening elements across said slot; and (f) said sharpening elements crossing each other opposite said slot as they pivot downwardly in response to such an elongated cutting tool as the latter is drawn downwardly, outwardly, and through said slot.

2. The apparatus defined in claim 1, wherein said abutment means is carried by said base at opposite sides of said slot adjacent one of said pivot points in position to limit and vary the extent of descent of the sharpening element having its pivot point at the same side of said slot and to limit the movement of said force means connected to said descending sharpening element and thereby limit the extent of upward movement of the pivoting sharpening element connected thereto.

3. The apparatus defined in claim 1, and (g) a third, non-paired sharpening element pivotally secured to said base member and pivoting in common about the pivot point of one of said sharpening elements of said pair and extending downwardly from its said common pivot point and across said slot at the same elevation as the other of said sharpening elements having the same point of pivot; and (h) a third force means connected to the upper end portion of said third sharpening element and having a force sufficient to cause said third sharpening element to pivot about its said pivot point and across said slot in unison with said sharpening element which pivots therewith about said common pivot point as such an elongated cutting tool is drawn downwardly and outwardly through and away from said slot.

4. The structure defined in claim 3, wherein said third sharpening element is disposed outwardly of each of said other sharpening elements and on the same side of said base member.

5. The sharpening apparatus defined in claim 3, wherein said third force means is of lesser force value than each of said first two mentioned force means.

6. The sharpening apparatus defined in claim 3, wherein said third force means is of lesser force value than the said counterweight connected to the said sharpening element having the same pivot point as said third sharpening element.

7. The sharpening apparatus defined in claim 1, wherein said sharpening elements are curved sufficiently so as to provide a substantially uniform angle of contact between the cutting edge surfaces of the cutting tool and the sharpening contacts of the sharpening elements as the cutting tool is moved downwardly and outwardly through said elongated slot.

8. Apparatus for providing a sharpened cutting edge on an elongated cutting tool, comprising:

(a) a base member extending in an upright plane and having an elongated vertically extending slot therein;

(b) a pair of elongated sharpening elements, each of which is pivotally secured to said base member at a point adjacent to and on opposite sides of the upper end of said slot;

(c) each of said elements having a sharpening portion extending downwardly relative to its pivot point and across said slot in crossed adjacent relation with the other one of said pair of elements and each being swingable downwardly across said slot in adjacent parallel planes;

(d) force means connected to the upper portions of each of said sharpening elements in position to apply a predetermined force thereto to cause each of said elements to pivot about its pivot point across said slot and in crossed relation along said slot, said elements intersecting with each other as they cross said slot as such a cutting tool is drawn through said slot so as to provide contact sharpening surfaces to each side of the cutting edge of the elongated cutting tool passing through said slot; and (e) camming means carried by said base member at each side of said slot adjacent one of said pivot points and in the path of downward swinging movement across said slot of each element of said pair of sharpening elements to cause the same to flex thereabout as said elements engage said camming means, and thereby increase the pressure required upon a cutting tool to move the latter downwardly and outwardly through and away from said slot and to change the bevel at which the sharpening elements engage the cutting tool adjacent its cutting edge.

9. The apparatus defined in claim 8, wherein said camming means is eccentrically adjustable.

10. The apparatus defined in claim 8, wherein said camming means is adjustable and is comprised of a pair of eccentrically mounted cams, one each of which functions as an abutment to limit the downward movement of one of said sharpening elements.

11. The apparatus defined in claim 8, wherein said camming means is comprised of a pair of eccentrically mounted cams, one each of which is on opposite sides of said slot and each of which is eccentrically adjustable while limiting the extent of downward movement of one of said pair of sharpening elements to thereby alter the angle and pressure at which said sharpening surfaces of said elements engage the cutting tool as it is initially drawn across said sharpening elements and through said slot.

12. The apparatus defined in claim 8, wherein said camming means includes cams positioned on opposite sides of said slot, each of said cams being positioned between one of said sharpening elements and its said associated force means.

13. The apparatus defined in claim 8, wherein said camming means includes a pair of eccentrically mounted adjustable cams each positioned at opposite sides of said slot, each of said cams being positioned between one of said sharpening elements and its associated said force means and restricting the downward movement of its associated force means as well as the extent of swinging movement of its associated sharpening element.

14. The apparatus defined in claim 8, wherein said camming means includes a pair of adjustable eccentrically mounted cams each positioned on opposite sides of said slot, each of said cams being positioned between one of said sharpening elements and its associated force means and adjustably restricting the downward movement of its associated sharpening element, each of said cams being adjustable to thereby adjust the elevation and angle at which the sharpening action commences when an elongated cutting tool is drawn through said slot in sharpening contact with said sharpening elements.

15. Apparatus for providing a sharpened cutting edge on an elongated cutting tool, comprising:

(a) a base member extending in an upright plane having an elongated vertically extending slot therein;

(b) a pair of adjacent elongated sharpening elements, each of which is pivotally secured to said base member at a pivot point adjacent to and on opposite sides of the upper end of said slot;

(c) each of said elements having a curved portion extending downwardly relative to its said pivot point and curving laterally across the plane of said slot, and being swingable across said slot in a plane parallel to the plane of said base member;

(d) separate force means connected to the upper end portion of each of said sharpening elements and having a force sufficient to cause each of said elements to pivot about its said pivot point and across said slot, said elements intersecting with each other when they cross said slot as the cutting tool is drawn through said slot so as to provide contact sharpening surfaces to each side of the cutting edge of the elongated cutting tool passing through said slot; and (e) separate abutment means carried by said base in the path of downward movement of each of said elements at opposite sides of said slot in position to limit the extent of descent across said slot of said sharpening element which has its pivot point on the same side of said slot to cause the same to flex and pivot thereabout as said elements engage said abutment means, and thereby increase the pressure required upon a cutting tool to move the latter downwardly and outwardly through and away from said slot and thereby change the bevel at which the sharpening elements engage the sides of the cutting tool adjacent its cutting edge.

16. Apparatus for providing a sharpened cutting edge on an elongated beveled cutting tool, comprising:

(a) a base member extending in an upright plane and having an elongated vertically extending slot therein;

(b) a pair of elongated sharpening elements, each of which is pivotally secured to said base member at a point adjacent to and on opposite sides of the upper end of said slot;

(c) each of said elements having a sharpening section extending downwardly relative to its said pivot point and across said slot in crossed relation with the other of said pair of elements and each being swingable downwardly across said slot in adjacent planes parallel to each other;

(d) force means connected to the upper portions of each of said sharpening elements in position to apply a predetermined force thereto to cause each of said elements to pivot about its said pivot point across said slot and in crossed relation along said slot, said elements intersecting with each other when they cross said slot as such a cutting tool is drawn through said slot, so as to provide contact sharpening surfaces to each side of the cutting edge of the elongated cutting tool passing through said slot; and (e) said sharpening sections of said sharpening elements each having a curved concave upper portion, a convex intermediate portion, and a lower portion which is carried by said intermediate portion and is of lesser convexity as compared to the curvature of said intermediate portion so as to alter the bevel at which said sharpening contacts engage the cutting edge of the elongated cutting tool passing through said slot as the cutting tool engages said convex intermediate portion and said lower portion.

17. The apparatus defined in claim 16, wherein each of said sharpening elements include a concave upper portion, a slightly convex lower portion, and a convex intermediate portion, the latter having a greater degree of convexity than said lower portion.

18. The apparatus defined in claim 16, wherein said lower portions of said sharpening elements move in crossed relation along said slot as a cutting tool is drawn through said slot and said lower portions defined a smaller angle than the angle defined by said concaved upper portions of said sharpening elements.

19. Apparatus for providing a sharpened cutting edge on an elongated cutting tool, comprising:

(a) a base member extending in an upright plane having an elongated vertically extending slot therein;

(b) a pair of elongated sharpening elements, each of which is pivotally secured to said base member at a point adjacent to and on opposite sides of the upper end of said slot;

(c) each of said elements having a sharpening portion extending downwardly relative to its said pivot point and across said slot in crossed relation with the other of said pair of elements and each being swingable downwardly across said slot in adjacent planes parallel to each other;

(d) separate force means connected to the upper portions of each of said sharpening elements in position to apply a predetermined force thereto to cause each of said elements to pivot about its said pivot point across said slot and in crossed relation along said slot, said elements intersecting with each other when they cross said slot as such a cutting tool is drawn through said slot so as to provide contact sharpening surfaces to each side of the cutting edge of the elongated cutting tool passing through said slot;

(e) a third elongated sharpening element pivotally secured to said base member adjacent said pair and at the pivot point of one of said sharpening elements of said pair, and extending downwardly relative to its pivot and across said slot in closely crossed relation to its most adjacent sharpening element of said pair and intersecting said adjacent element along said slot as they cross said slot, as such a cutting tool is drawn through said slot so as to impart a truly correct edge to the cutting tool;

(f) third force means connected to the upper portion of said third sharpening element in position to apply a predetermined force thereto to cause the latter to pivot about its pivot point and swing downwardly with said pair of sharpening elements to provide a final contact sharpening surface and produce a final correct cutting edge to the elongated cutting tool passing through said slot; and (g) said third force means having a lesser force value than either of said separate force means in order to attain a more fine and true edge.

20. The apparatus defined in claim 19, wherein each of said sharpening elements has curved sharpening portions and has approximately the same degree of curvature in said curved sharpening portions.

21. Apparatus for providing a sharpened cutting edge on an elongated cutting tool, comprising:

(a) a base member extending in an upright plane having an elongated vertically extending slot therein;

(b) a pair of elongated sharpening elements, each of which is pivotally secured to said base member at a pivot point adjacent to and on opposite sides of the upper end of said slot;

(c) each of said elements having a curved portion extending downwardly relative to its said pivot point and curving laterally across the plane of said slot in crossed relation with the other, and being swingable downwardly across said slot in adjacent planes parallel to the plane of said base;

(d) force means connected to the upper portions of each of said sharpening elements in position to cause said element to pivot about its said pivot point across said slot and in crossed relation along said slot, said elements intersecting with each other when they cross said slot as such a cutting tool is drawn through said slot, so as to provide contact sharpening surfaces to each side of the cutting edge of the elongated cutting tool passing through said slot; and (e) adjustable camming means carried by said base at opposite sides of said slot in position to limit and vary the extent of downward swinging movement of each of said sharpening elements across said slot.

22. Apparatus for providing a sharpened cutting edge on an elongated beveled cutting tool, comprising:

(a) a base member extending in an upright plane and having an elongated vertically extending slot therein;

(b) a pair of elongated sharpening elements, each of which is pivotally secured to said base member at a point adjacent to and on opposite sides of the upper end of said slot;

(c) each of said elements having a sharpening section extending downwardly relative to its said pivot point and across said slot in crossed relation with the other of said pair of elements and each being swingable downwardly across said slot in adjacent planes parallel to each other;

(d) force means connected to the upper portions of each of said sharpening elements in position to apply a predetermined force thereto to cause each of said elements to pivot about its said pivot point across said slot and in crossed relation along said slot, said elements intersecting with each other when they cross said slot as such a cutting tool is drawn through said slot, so as to provide contact sharpening surfaces to each side of the cutting edge of the elongated cutting tool passing through said slot;

(e) said sharpening sections of said sharpening elements each having a curved concave upper portion and a slightly convex lower portion so as to alter the bevel at which said sharpening contacts engage the cutting edge of the elongated cutting tool passing through said slot when the cutting edge engages said lower portion.

23. Apparatus for providing a sharpened cutting edge on an elongated beveled cutting tool comprising:

(a) a base member extending in an upright plane and having an elongated vertically extending slot therein;

(b) a pair of elongated sharpening elements, each of which is pivotally secured to said base member at a point adjacent to and on opposite sides of said slot;

(c) each of said elements having sharpening sections extending downwardly relative to its said pivot point and across said slot in crossed relation with the other of said pair of elements and each being swingable downwardly across said slot in adjacent planes parallel to each other;

(d) force means connected to the upper portions of each of said sharpening elements in position to apply a predetermined force thereto to cause each of said elements to pivot about its said pivot point across said slot and in crossed relation along said slot, said elements intersecting with each other when they cross said slot as such a cutting tool is drawn through said slot, so as to provide contact sharpening surfaces to each side of the cutting edge of the elongated cutting tool as it passes through said slot;

(e) said sharpening sections of each of said sharpening elements including a concave upper sharpening portion, a convex intermediate portion, and a lower sharpening portion which has a lesser degree of curvature as compared to said intermediate portion.

* * * * *

UNITED STATES PATENT AND TRADEMARK OFFICE

CERTIFICATE OF CORRECTION

PATENT NO. : 5,655,959

DATED : August 12, 1997

INVENTOR(S) : Juranitch

It is certified that error appears in the above-identified patent and that said Letters Patent is hereby corrected as shown below:

Column 4, line 5, "18b and 19b" should be --18a and 19a--

Column 4, line 6, "18b and 19b" should be --18a and 19a--

Column 4, line 10, "18b and 19b" should be --18a and 19a--

Signed and Sealed this

Ninth Day of December, 1997

Bruce Lehman

*Attest:*

BRUCE LEHMAN

*Attesting Officer*

*Commissioner of Patents and Trademarks*